United States Patent [19]

Shikimi

[11] 4,307,672

[45] Dec. 29, 1981

[54] SWING SHELF

[76] Inventor: Yoshiharu Shikimi, 2277-8, Higashihukatsu-machi, Hiroshima-ken, Hukuyama-shi, Japan

[21] Appl. No.: 721,374

[22] Filed: Sep. 8, 1976

[30] Foreign Application Priority Data

Sep. 8, 1975 [JP] Japan ..... 50-122885[U]
Aug. 5, 1976 [JP] Japan ..... 51-104026[U]

[51] Int. Cl.[3] ..... A47B 11/00

[52] U.S. Cl. ..... 108/139; 108/152; 248/282; 248/289.1; 403/157

[58] Field of Search ..... 108/139, 152, 134; 248/282, 289 R, 240; 403/157, 158, 161, 162; 16/140

[56] References Cited

U.S. PATENT DOCUMENTS

| | | | |
|---|---|---|---|
| 397,225 | 2/1889 | Clow | 108/139 |
| 438,039 | 10/1890 | Walters | 108/152 |
| 1,002,783 | 9/1911 | Sweet | 248/282 |
| 1,007,590 | 10/1911 | Miller | 248/282 X |
| 1,847,937 | 3/1932 | Fetters | 16/140 |
| 2,164,390 | 7/1939 | Dickerson | 248/282 |
| 2,237,455 | 4/1941 | Slawski | 108/139 X |
| 2,240,709 | 5/1941 | Mead | 403/162 |
| 3,512,742 | 5/1970 | Robson, Jr. | 248/240 |
| 3,825,357 | 7/1974 | Hilton | 403/161 |
| 3,920,276 | 11/1975 | Sparrow | 108/150 X |

FOREIGN PATENT DOCUMENTS

| | | | |
|---|---|---|---|
| 1322343 | 2/1963 | France | 403/157 |
| 1406564 | 6/1965 | France | 248/282 |
| 224998 | 11/1924 | United Kingdom | 403/162 |
| 380668 | 9/1932 | United Kingdom | 248/289 R |

*Primary Examiner*—William E. Lyddane
*Attorney, Agent, or Firm*—Birch, Stewart, Kolasch & Birch

[57] ABSTRACT

A swing shelf comprising a support arm, a shelf, a first means for rotatably mounting said shelf to one end portion of said support arm, said shelf being adapted to be fixedly secured to said support arm in any desired position, a mounting means adapted to be mounted to any desired surface, and second means for rotatably mounting the other end portion of said support arm to said mounting means, said mounting means being adapted to be fixedly secured to said support arm at any desired position.

2 Claims, 16 Drawing Figures

SWING SHELF

BACKGROUND AND SUMMARY OF THE INVENTION

The present invention relates to a shelf which is capable of being swung freely in the same plane.

There has heretofore been known a shelf which can be fitted to a wall or a column, etc., and which can be rotated or pivoted within a predetermined angle so as to change the position thereof relative to the mounting portion thereof. However, heretofore there has never been employed a shelf which permits a support arm thereof to be rotated relative to the mounting portion thereof so as to change the position thereof, while at the same time enables the shelf per se to be freely rotated about its pivot shaft. The development of such a shelf which not only enables the position of mounting portion to be altered, as desired, but also enables the position of the shelf itself to be freely changed relative to its support arm, has been earnestly desired from the viewpoint of an effective utilization of narrow space, or in view of the relationship between the shelf itself and articles to be placed thereon or from the decorative design point of view. The shelf of the present invention has been developed to solve the above-mentioned problem and has an extremely high utility as mentioned hereinbelow.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

FIG. 1 shows the swing shelf according to the present invention mounted on wall W. Reference numeral 1 denotes a shelf, and numeral 2 a support arm for supporting the shelf. The shelf 1 is pivotally mounted to the leading end of the support arm 2 by means of a mounting structure which will be discussed in detail hereinbelow. The base of the support 2 is pivotally mounted to a mounting means 3.

FIGS. 2 and 6 are enlarged detail views of the swing shelf. The shelf 1 is fixedly secured to a bracket 4 by means of small screws, etc. The bracket 4 has an L-shaped upper part and has a cylindrical lower part 5 formed as an integral part of the upper part (see FIG. 5). Further, the bracket 4 is molded as a single unit by casting, e.g., using an aluminum alloy, etc. Reference numeral 6 represents an outer cylindrical member adapted to be fitted to the outside of the cylindrical part of the bracket 4 and which is formed as an integral part of the support arm 2 at the leading end thereof. Reference numeral 7 denotes a lower retainer cylinder adapted to be fitted in the lower part of the outer cylindrical member 6. The lower retainer cylinder 7 has a flange 8 which abuts against the lower end of the outer cylindrical member 6. Each of the cylindrical parts 5 of the bracket 4 and the lower retainer cylinder 7 has formed therein loose holes through which a bolt 9 extends.

Figure 1:
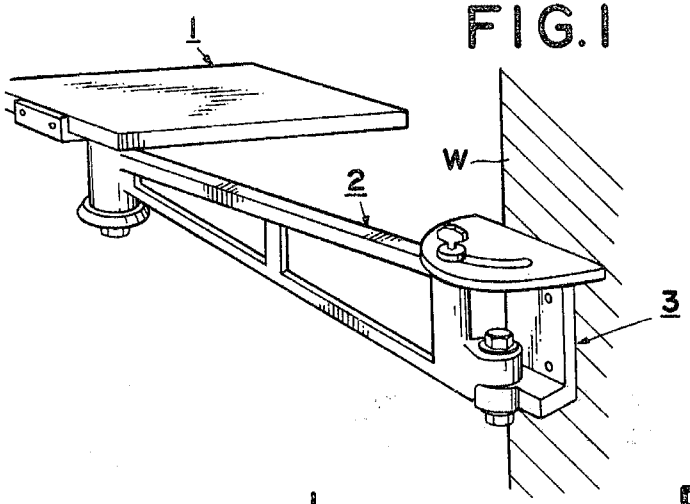
FIG. 1 is a perspective view of one example of a swing shelf according to the present invention.
Figure 2:
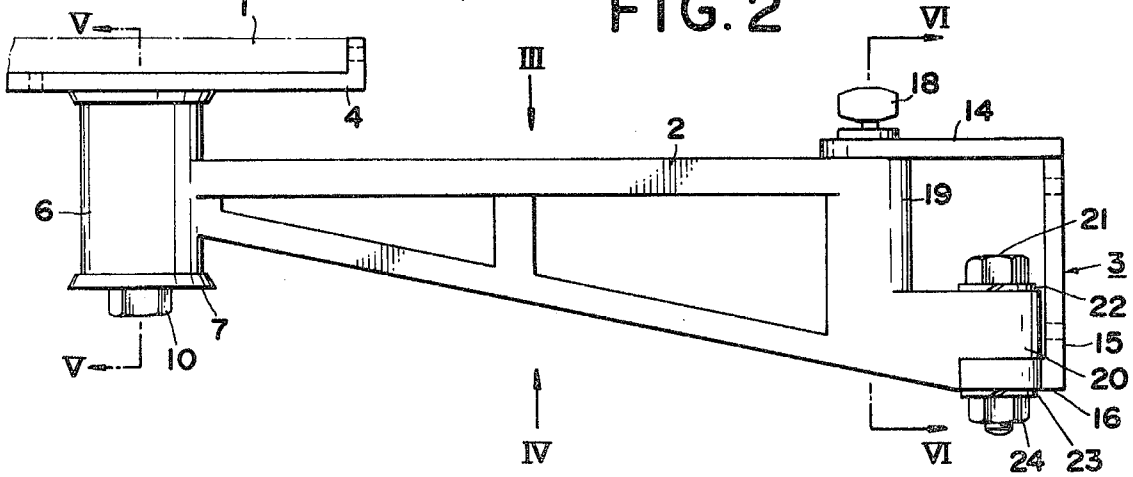
FIG. 2 is a side elevational view of the swing shelf shown in FIG. 1.
Figure 3:
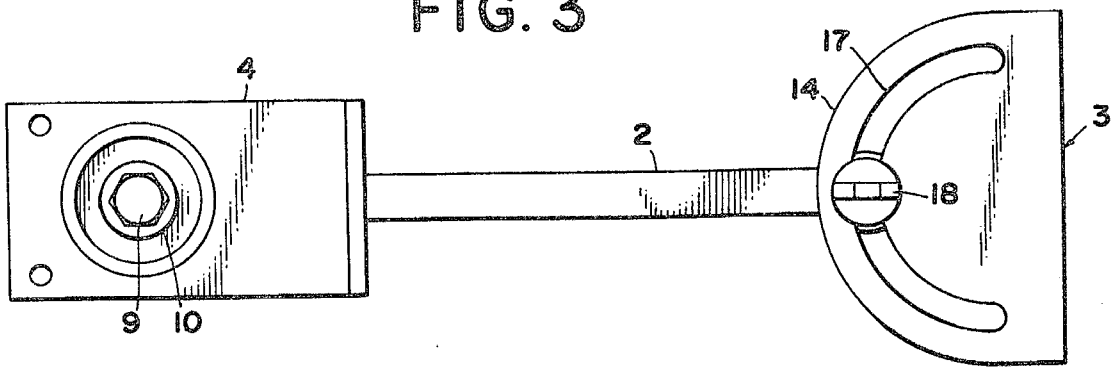
FIG. 3 is a plan view of the swing shelf viewed in the direction shown by an arrow III in FIG. 2.
Figure 4:
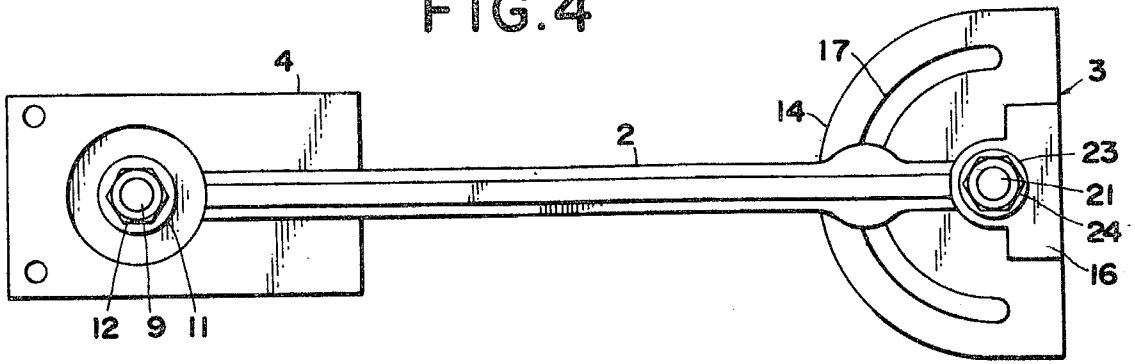
FIG. 4 is a bottom plan view of the swing shelf viewed in the direction shown by an arrow IV in FIG. 2.
Figure 6:
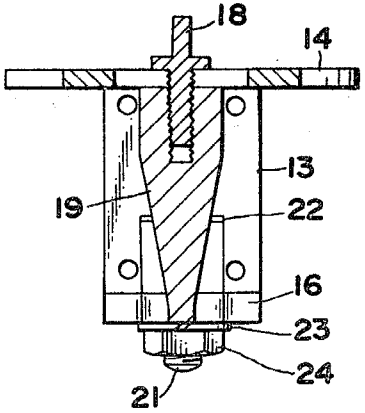
FIG. 6 is a sectional view of the swing shelf taken along line VI—VI in FIG. 2.

In assembly, the bolt 9 is inserted into the loose hole of the cylindrical part 5 from above through a washer 10 and into the loose hole of the lower retainer cylinder 7, and is then fastened through a spring washer 11 by means of a nut 12. The rotational friction force exerted in the region 13 between the bracket 4 and the outer cylindrical member 5 can be adjusted by regulating the tightening force applied to the nut 12.

The mounting means 3 comprises an upper semicircular portion 14, a mounting portion 15 extending at right angles to the mounting portion 14 and a lower supporting portion 16, all of which form an integral unit. The upper semicircular portion 14 has an elongated semicircular groove 17 formed therein, and can be fixedly secured to the support arm 2 at any desired position by screwing a butterfly screw 18 in a hub 19 of the support arm 2.

The lower supporting portion 16 is engaged with the lower part of a rearwardly projecting part 20 of the support arm 2, and is rotatably fastened through washers 22 and 23 by means of a bolt 21 and a nut 24.

Since the present invention is constructed as mentioned hereinabove, the support arm 2 and the shelf 1 can be disposed horizontally by fixedly securing the mounting portion 15 to a wall or a column, etc., at a desired position, by means of screws. The support arm 2 can be freely pivoted about the bolt 21 and fixed at a desired angular position by tightening up the butterfly screw 18. Further, the shelf 1 is also capable of being pivoted about the bolt 9. The position of the shelf 1 can be fixed by the action of the frictional force exerted in the region 13 where the bracket 4 is brought into contact with the outer cylindrical member 6 by adjusting the tightening force applied to the nut 12.

Figure 5:
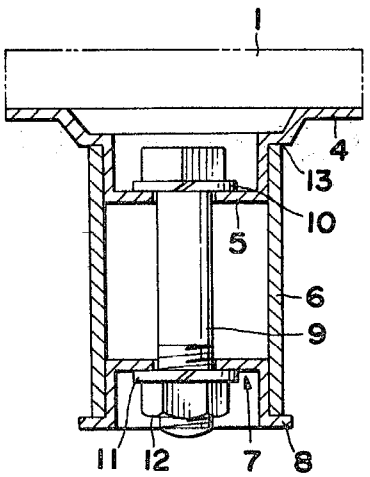
FIG. 5 is a sectional view of the swing shelf taken along line V—V in FIG. 2.
Figure 7:
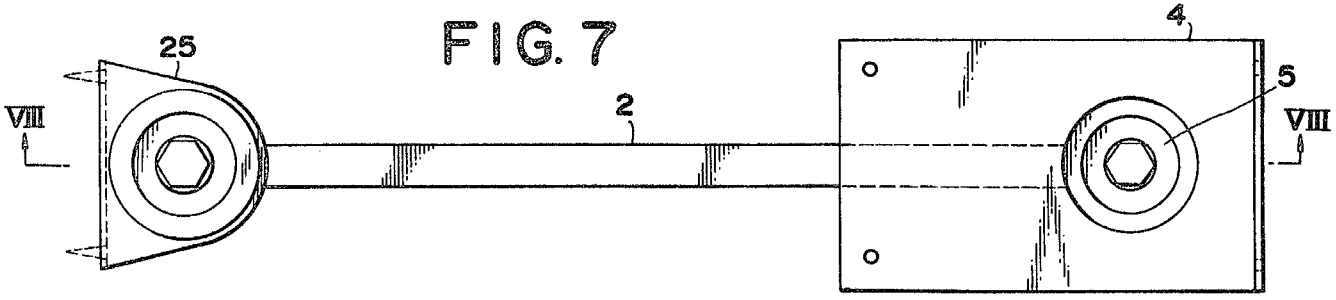
FIG. 7 is a plan view of another embodiment of the swing shelf according to the present invention.
Figure 8:
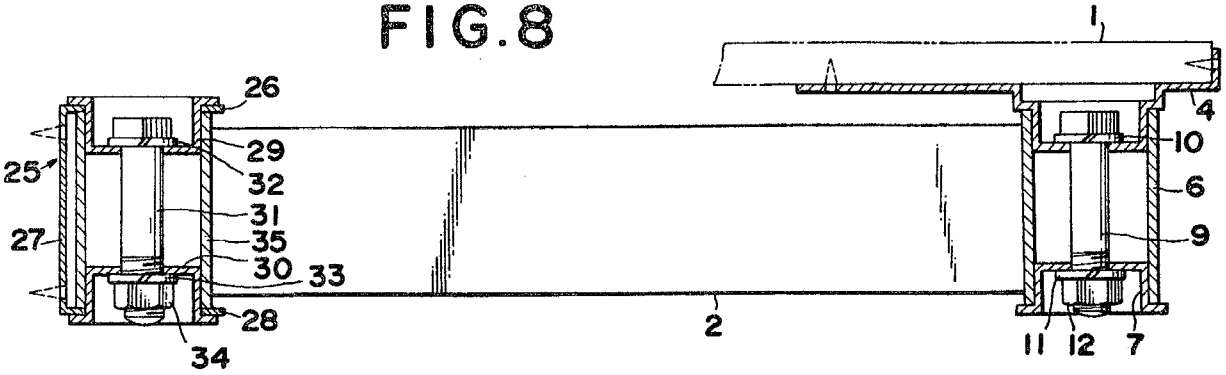
FIG. 8 is a sectional view of the embodiment of FIG. 7 taken along line VIII—VIII in FIG. 7.

FIGS. 7 and 8 illustrate another embodiment of the present invention. In this example, the structure of the mounting portion of the shelf 1 is the same as that of the first-mentioned embodiment. (Please refer to FIG. 5.) However, the mounting means for the support arm 2 differs from that of the first embodiment. In this example, there is no butterfly screw 18 for fixing the support arm 2.

Reference numeral 25 denotes a support bracket for supporting the shelf mounting portion which comprises an upper plate 26, a vertical mounting portion 27, and a lower plate 28. Each of the upper plates 26 and the lower plate 28 has a hole formed therein which is concentric with and of a diameter equal to the inner diameter of an outer cylinder 35 formed as an integral part of the support arm 2 at one end thereof. An upper cylindrical member 29 and a lower cylindrical member 30 are fitted in the concentric holes of the upper and lower plates, respectively.

Each of the upper cylindrical member 29 and the lower cylindrical member 30 has a hole formed therein through which a bolt 31 passed. The bolt 31 is tightened up through a washer 32 and a spring washer 33 by means of nut 34. In this case, the support arm 2 can be fixedly secured at any desired position by adjusting the tightening force applied to the nut 34, thereby regulating the frictional force exerted between the upper and lower ends of the outer cylinder 35 and the support bracket 25.

Figure 9:
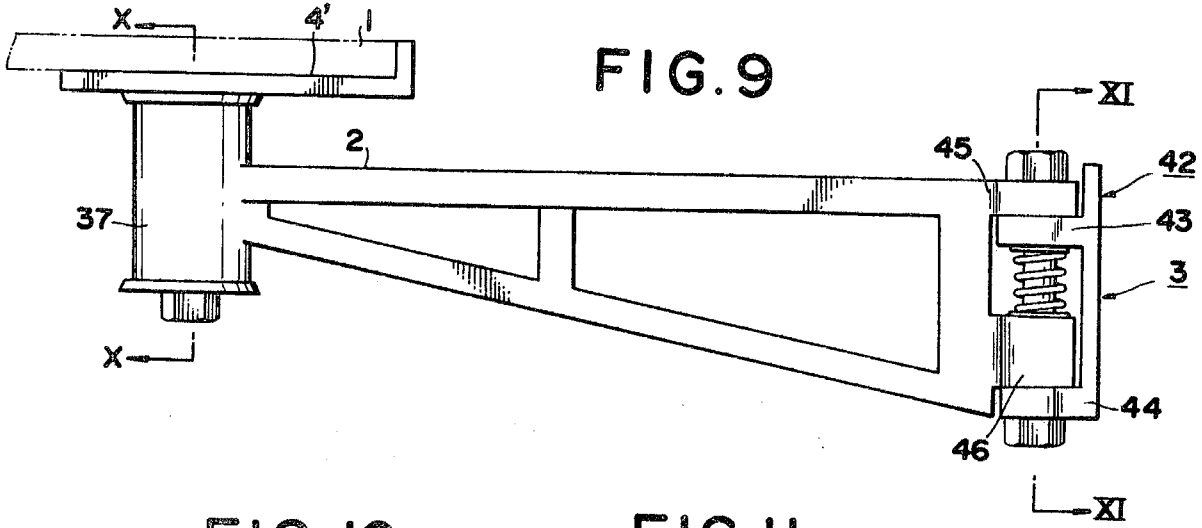
FIG. 9 shows still a further embodiment of the swing shelf of the present invention.
Figure 11:
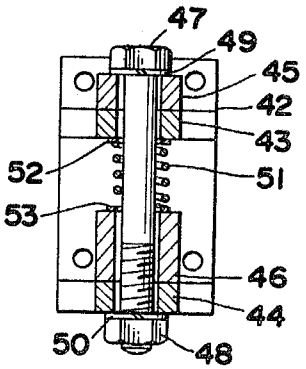
FIG. 11 is a sectional view of the embodiment of FIG. 9 taken along line XI—XI in FIG. 9.
Figure 10:
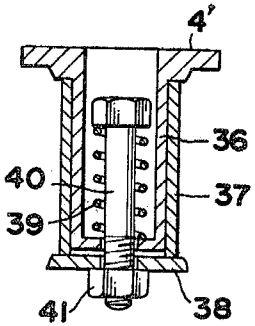
FIG. 10 is a sectional view of the embodiment of FIG. 9 taken along line X—X in FIG. 9.
Figure 12:
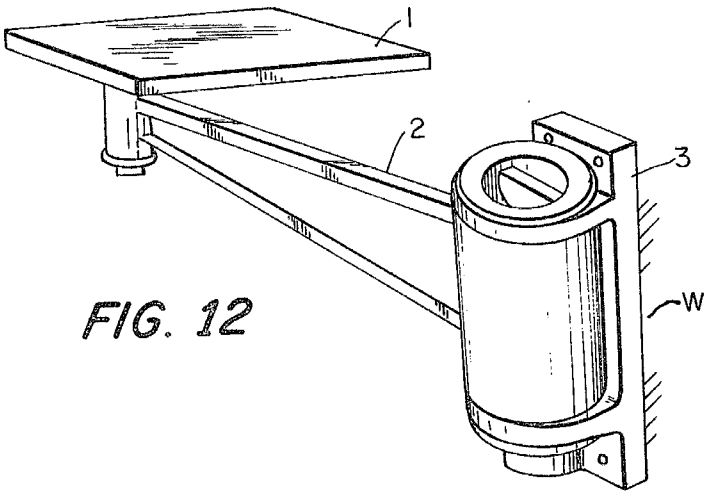
FIG. 12 is a perspective view showing another embodiment of a swing shelf according to the present invention fitted to a wall.
Figure 13:
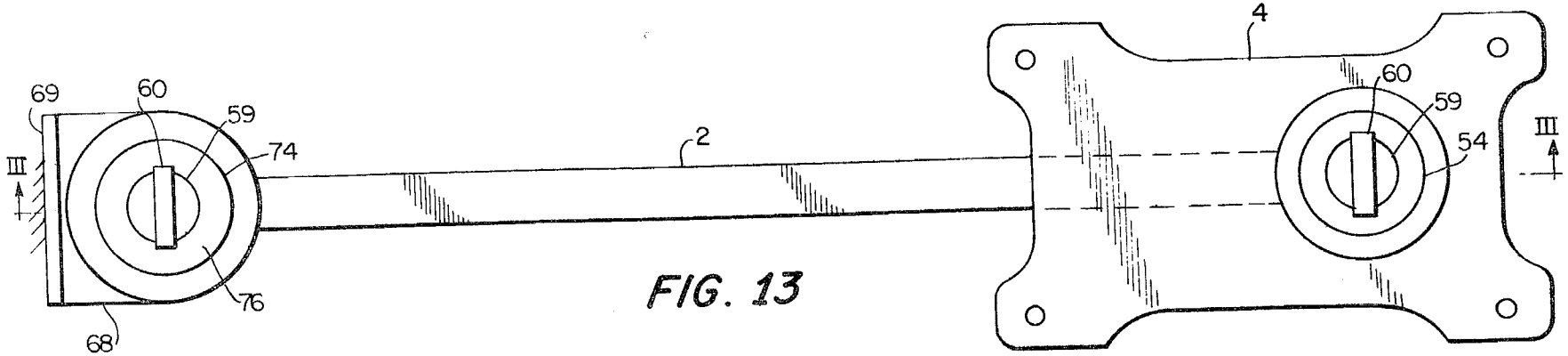
FIG. 13 is a plan view of the swing shelf shown in FIG. 12.
Figure 14:
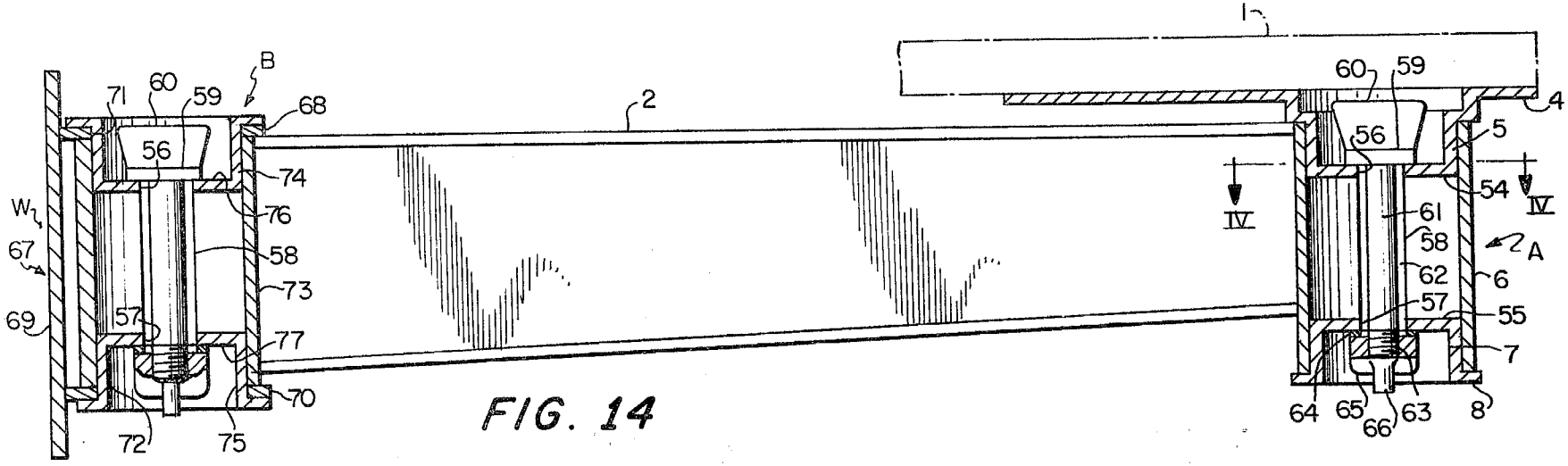
FIG. 14 is a view taken in the direction indicated by the arrows III—III in FIG. 13.

FIGS. 9 to 11 illustrate still a further embodiment of the present invention. In this embodiment, both the shelf mounting portion and the support arm mounting means differ from those of the above-mentioned two examples.

Reference numeral 4' represents a bracket for mounting the shelf 1 thereon which has an L-shaped upper surface and also comprises, in the bottom part thereof, a cylindrical portion 36 formed as an integral part thereof. The cylindrical portion 36 is fitted in an outer cylinder 37 formed integrally with the leading end of the support arm 2.

Reference numeral 38 denotes a lower retainer plate with a hole formed therein through which a bolt 40 passes. The lower end of the bolt 40 which is inserted through a coiled spring 39 within the cylindrical portion 36 is fastened by means of nut 41. Therefore, the frictional force exerted between the bracket 4' and the outer cylinder 37 can be adjusted by regulating the tightening force applied to the nut 41 so that the movement of the shelf 1 can be controlled and the position thereof can be fixed.

FIG. 11 is a detailed sectional view of the portion for mounting the support arm 2. Reference numeral 42 denotes a mounting plate, and an upper portion 43 and a lower portion 44 project horizontally at right angles thereto. The upper portion 43 and the lower portion 44 are inserted under upper supporting member 45 and lower supporting member 46 formed, respectively, in the mounting portion of the support arm 2 so as to carry the supporting member 45 and 46. Supporting members 45 and 46 are tightened up through spring washers 49 and 50 by means of bolt 47 and nut 48. Reference numeral 51 denotes a coiled spring interposed betwween the upper portion 43 and the lower supporting member 46. Washers 52 and 53 are located above and under the coiled spring 51 so as to provide frictional contact with the lower surface of the upper portion 43 and the upper surface of the lower supporting member 46, respectively. Since the arrangement is made as mentioned above, the rotational angle of the support arm 2 can be controlled, and so the support arm can be fixed at a desired angular position by regulating the tightening force applied to the nut 48 and varying the spring constant of the coiled spring 51.

FIGS. 12 to 16 illustrate other embodiments of the present invention. Reference numerals 1 to 8 are used in these figures to denote the same components as represented in FIGS. 1 to 11. The characteristic features of the embodiments shown in FIGS. 12 to 16 will be described as follows.

The bracket 4 includes a cylindrical lower part 5 having a bottom wall 54, and the lower retainer cylinder 7 has a top wall 55. Each of the bottom wall 54 and the top wall 55 has elongated or oval holes 56 and 57 formed, respectively, in the central portion thereof through which a bolt 58 extends. (See FIG. 15.)

The bolt 58 has a circular head 59 and a flat knob 60 which is placed on the head and formed as an integral part thereof. The bolt 58 has a main body portion comprising, when viewed in cross section, straight portions 61, and circular or shaped portions 62, both of which can pass through the above-mentioned holes 56 and 57. Reference numeral 63 denotes a screw threaded portion formed in the lower part of the bolt 58. Reference numeral 64 represents a washer, and element 65 represents a nut which is adapted to be threadably engaged with the screwed threaded portion 63. The nut 65 has a flat knob 66 formed as an integral part thereof. The bolt-nut assembly can be assembled and adjusted manually in a simple manner by turning the nut 65 so as to permit the screw threaded portion 63 to be screwed in the latter.

In assembling the shelf mounting portion "A", the bolt 58 is inserted into the oval hole 56 of the bracket 4, and then the cylindrical lower part of the bracket 4 is fitted in the cylindrical member 6 fitted at the leading end of the support arm 2.

Thereafter, the lower retainer cylinder 7 is fitted from the underside thereof in the cylindrical member 6. At that time, the lower end of the bolt 58 is inserted in the oval hole 15 of the lower retainer cylinder 7. Subsequently, the screw threaded portion 63 is inserted in a washer 64, and then the nut 65 is threadably engaged with the screw threaded portion 63.

When it is desired to adjust the position of the shelf 1, it is only necessary to loosen the nut by the fingers, rotate the shelf 1 to a desired position, and then screw down the nut 65 again. In this case, the main body portion of the bolt 58 is firmly engaged with the oval holes 56 and 57 without causing any rotation so that there is no inconvenience in fastening and loosening the nut 65.

Reference character "B" denotes that portion of the support arm 2 which is adapted to be fitted to wall W, etc. Reference numeral 67 denotes a support bracket which comprises an upper plate 68, a vertical mounting portion 69 and a lower plate 70. Each of the upper plate 68 and the lower plate 70 has holes 71 and 72, respectively, which are formed concentrically with and equal to the inside diameter of an outer cylinder 73 formed at one end of the support arm 2 as an integral part thereof. Fitted in the circular holes 71 and 72 are an upper cylindrical member 74 and a lower cylindrical member 75. The upper cylindrical member 74 and the lower cylindrical member 75 have the same structure as that of the lower retaining cylinder 7 of the shelf mounting portion "A", and the upper cylindrical member 74 includes a bottom wall 76, while the lower cylindrical member 75 includes a top wall 77. The bottom wall 76 and the top wall 77 have oval concentric holes 56 and 57, respectively, formed in the central portions thereof so as to pass the bolt 58 therethrough. The bolt 58 has the same constructions as that of the bolt 58 adapted to be used in the shelf mounting portion "A", except that its length differs from that of the latter. Therefore, a detailed description of the bolt 58 is omitted herein.

Figure 16:
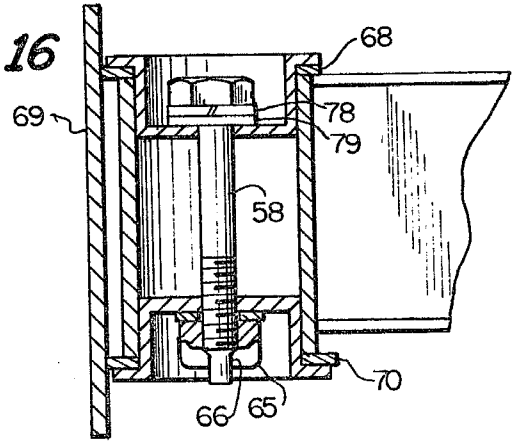
FIG. 16 shows another embodiment of the shelf portion fitted to the wall.
Figure 15:
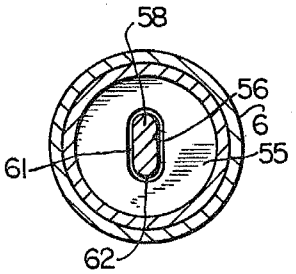
FIG. 15 is a cross-sectional view taken in the direction shown by arrows IV—IV in FIG. 14.

FIG. 16 shows another exsmple of the portion "B" adapted to be fitted to a wall, etc. In this example, bolt 58 is the same in construction as the bolt 58 used in the embodiment shown in FIG. 14, except that the former is a well-known hexagonal bolt. The upper cylindrical member 74 and the lower cylindrical member 75 can be fastened together by screwing in the nut 65. However, since the bolt 58 has a circular main body, a spring washer 78 and an ordinary washer 79 are located under the head portion of the bolt so as to prevent idle turning of the upper and lower cylindrical members 74 and 75 relative to each other.

FIG. 16 illustrates the structure of the portion "B" adapted to be fitted to a wall etc., which can, of course, be used as the shelf mounting portion "A".

The mounting portions shown in the embodiments of FIGS. 12 to 16 are simple in construction, and the bolts and nuts employed therein can be operated by fingers, and so the mounting portion can be assembled and disassembled and adjusted in position very easily. Therefore, assembly and disassembly of the mountings can be effected easily, even by a woman or a child, without requiring the use of a special tool.

As described and shown in the foregoing embodiments, the swing shelf according to the present invention enables the support arm mounting portion and the shelf mounting portion to be rotated freely and independently for adjusting their positions and also enables the support arm to be fixedly secured in any desired position by the action of the frictional force due to the resilient force of a spring or by means of a butterfly screw. Therefore, the swing shelf can be fitted to a wall or a column, etc., and the position thereof can be changed as desired.

Since the swing shelf according to the present invention is constructed as mentioned above, it can be effectively utilized even in a narrow space by swinging it aside when not in use and rotating to draw it out only when its used is desired.

By applying the above-mentioned advantage, the swing shelf according to the present invention can be utilized in offices, shops, houses, and the like.

For example, the shelf according to the present invention can be utilized as a telephone stand in offices, a utility shelf in kitchens, a display stand in shops, and an advertising lamp stand, etc. Its uses are limitless. Further, the shelf can be mounted and dismounted in a simple manner, and the size of the shelf can also be varied freely as and when required.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A swing shelf adapted for mounting to a surface which comprises (1) a horizontally disposed support arm provided for rotation about a vertical axis and having a shelf end portion and a wall end portion, each of said end portions containing a hollow cylindrical fixed substantially perpendicular to said support arm, (2) a substantially horizontally disposed shelf bracket member provided for rotation about a vertical axis, said bracket member having a top retainer means which extends from the bottom of said bracket member and is adapted to slidably fit into the top of the hollow cylindrical member at the shelf end portion of the support arm, a bottom retainer means adapted to slidably fit into the bottom of said hollow cylindrical member, means for fixedly securing said top retainer means to said bottom retainer means, thereby securing the shelf bracket member to said cylindrical member, and (3) a support bracket which is adapted to be mounted to a vertical wall, said support bracket having a vertical mounting for attachment to said vertical wall and spaced apart upper and lower plate means extending substantially perpendicular to said vertical mounting, said upper and lower plate means containing mutually aligned holes, the cylindrical member attached to the wall end portion of the support arm being in operative alignment with the holes in said plate means, top and bottom retainer means adapted to slidably fit through said holes in said plate means and into the top and bottom of said hollow cylindrical member and means for fixedly securing said top and bottom retainer means together, thereby securing said support arm to said support bracket.

2. The swing shelf of claim 1, wherein the top and bottom retainer at both end portions of the support arm are provided with apertures which are in alignment with each other and the means for securing said top and bottom retainer means together are adjustable nut-bolt means which extend through said apertures.

* * * * *